US011497323B1

(12) United States Patent
Ma et al.

(10) Patent No.: US 11,497,323 B1
(45) Date of Patent: Nov. 15, 2022

(54) CO-SLEEPER BASSINET WITH COLLAPSIBLE WALL PANELS

(71) Applicant: KawaBaby LLC, Bloomfield, NJ (US)

(72) Inventors: Kayla Ma, Bloomfield, NJ (US); Phillip Ma, Bloomfield, NJ (US)

(73) Assignee: KAWABABY LLC, Bloomfield, NJ (US)

( * ) Notice: Subject to any disclaimer, the term of this patent is extended or adjusted under 35 U.S.C. 154(b) by 0 days.

(21) Appl. No.: 17/094,050

(22) Filed: Nov. 10, 2020

Related U.S. Application Data

(60) Provisional application No. 62/933,872, filed on Nov. 11, 2019.

(51) Int. Cl.
*A47D 9/00* (2006.01)

(52) U.S. Cl.
CPC ..... *A47D 9/005* (2013.01)

(58) Field of Classification Search
CPC . A47D 9/00; A47D 9/005; A47D 9/02; A47D 9/04; A47D 7/00; A47D 7/002; A47D 7/005; A47D 7/01; A47D 7/02; A47D 7/03

See application file for complete search history.

(56) References Cited

U.S. PATENT DOCUMENTS 4,692,953 A * 9/1987 Fetters ..... A47D 9/005 5/99.1
10,299,608 B1 * 5/2019 Shi ..... A47D 7/005
2001/0011392 A1 * 8/2001 Homeyer ..... A47D 9/005 5/99.1
2005/0172400 A1 * 8/2005 Hardy ..... A47D 13/063 5/93.1
2010/0319122 A1 * 12/2010 Crumrine ..... A47D 9/005 5/99.1
2011/0119832 A1 * 5/2011 Hung ..... A47D 9/005 5/655
2012/0137429 A1 * 6/2012 Aaron ..... A47D 7/02 5/93.1
2013/0117930 A1 * 5/2013 Hsu ..... A47D 9/005 5/93.1
2013/0198952 A1 * 8/2013 Rong ..... A47D 13/063 5/99.1
2014/0208505 A1 * 7/2014 Burkholder ..... A47D 13/061 5/99.1
2017/0065100 A1 * 3/2017 Lange ..... A47D 13/063
2018/0035821 A1 * 2/2018 Bass-Conn ..... A47D 9/00
2021/0137280 A1 * 5/2021 Villano ..... A47D 15/008

OTHER PUBLICATIONS

Instructions, "Bassinet and Bedside Sleeper." https://babydelight.com, Jan. 1, 2018, pp. 1-12.
Instruction Manual, "By Your Side Sleeper." https://www.summerinfant.com, Jan. 1, 2015, pp. 1-2.

* cited by examiner

*Primary Examiner* — Peter M. Cuomo
*Assistant Examiner* — George Sun

(57) ABSTRACT

A foldable, portable co-sleeper bassinet or apparatus is described. The bassinet, in some embodiments, is transformable into two different configurations, by collapsing or extending the walls of the apparatus. For example, the co-sleeper apparatus may include collapsible wall panels that, when collapsed, enable an easy, lying-down open position, but which can extend back up to a walled position to secure a baby in the bassinet.

17 Claims, 7 Drawing Sheets

CO-SLEEPER BASSINET WITH COLLAPSIBLE WALL PANELS

CROSS-REFERENCES TO RELATED APPLICATIONS

This application claims priority to U.S. Provisional Patent Application No. 62/933,872, filed on Nov. 11, 2019, entitled CO-SLEEPER BASSINET WITH COLLAPSIBLE WALL PANELS, which is incorporated by reference in its entirety.

BACKGROUND

It is important to provide a safe environment for a sleeping baby. Therefore, when many co-sleeper products have been developed, the focus has been on providing a sturdy structure of the co-sleeper to ensure that a shared bed is a safe environment for the baby. Similarly, the parents (e.g., a mother who may nurse the baby without leaving the bed) should also be protected when in the bed, while also being comfortable and connected to their baby.

During an early months (e.g., when a baby is aged 0-6 months), such as until the baby can either roll over or push up, the baby will often gradually transition from being fed every 1 to 3 hours to being fed every 2 to 4 hours on average (e.g., once or twice a night). Many of these feeding sessions occur at night, which disrupt the sleep of the parents. Feeding a baby at night with minimal disruption to one's own sleep can be one of the most challenging aspects of early parenthood.

For example, there are usually two ways for nighttime breastfeeding, reflected in the following scenarios:

1) A mother picks up her baby from the crib/bassinet/co-sleeper, and she sits somewhere else to cradle the baby to night-feed or comfort (e.g., sofa, bed, and so on). A real risk is that the sleep-deprived mother may fall asleep while the baby is feeding, so she has to try to fight off sleep and stay awake, which doesn't always work;
2) A mother brings her baby into her bed to night-feed or comfort while lying down her exhausted body, and the baby falls asleep in the bed. Afterwards, she carefully tiptoes around back to the crib/bassinet/co-sleeper, and gently places the sleeping babe back down but the second her back touches the surface, the baby may awaken. Or, if the mother doesn't want to take that chance, then she sleeps next to her baby feeling afraid or guilty that she is somehow putting her baby's safety at risk by sleeping next to her in bed.

DETAILED DESCRIPTION OF THE INVENTION

Overview

The present disclosure provides a protected co-sleeping or bed-sharing environment where a mother or other parent can night-feed a baby with minimal movement and little disturbance to either the mother or the baby. A co-sleeper apparatus, such as a bassinet or other sleeping structure, having collapsible walls is described. The co-sleeper apparatus, in some cases adapted to be placed in a bed along with one or more sleeping parents, can be configured into at least two functional modes of use: (1) a feeding or access mode where the walls are collapsed, providing access to the baby by a parent (e.g., a mother about to feed the baby), and (2) a sleeping or secure mode, where the walls are extended and fixed in a secured or upright position.

Thus, the apparatus is transformable into two different configurations, simply by collapsing or extending the walls of the apparatus. For example, the co-sleeper apparatus may include collapsible wall panels that, when collapsed, enable an easy, lying-down breastfeeding position, but which can extend back up to a walled position, similar to traditional co-sleepers and bassinets.

In some embodiments, the co-sleeper can be placed in the same bed where a parent is sleeping. A mother can simply collapse the wall panels for night-feeding, and then extend them back up afterwards without disturbing or moving the baby, allowing the mother to perform safe night-feeding and comforting next to the baby, while also providing protection for the baby when both are asleep. The collapsible co-sleeper/bassinet is also portable and can be easily carried around during trips or placed at other locations (e.g., the floor, another bed) within the house.

A detailed description of embodiments is provided below along with accompanying figures. The scope of this disclosure is limited only by the claims and encompasses numerous alternatives, modifications and equivalents.

Numerous specific details are set forth in the following description. These details are provided to promote a thorough understanding of the scope of this disclosure by way of specific examples, and embodiments may be practiced according to the claims without some of these specific details. Accordingly, the specific embodiments of this disclosure are illustrative, and are not intended to be exclusive or limiting. For the purpose of clarity, technical material that is known in the technical fields related to this disclosure has not been described in detail so that the disclosure is not unnecessarily obscured.

Aspects of the present disclosure have been described in conjunction with the specific embodiments thereof that are proposed as examples. Numerous alternatives, modifications, and variations to the embodiments as set forth herein may be made without departing from the scope of the claims set forth below. Accordingly, embodiments as set forth herein are intended to be illustrative and not limiting.

Examples of the Co-Sleeper Apparatus

Figure 1:
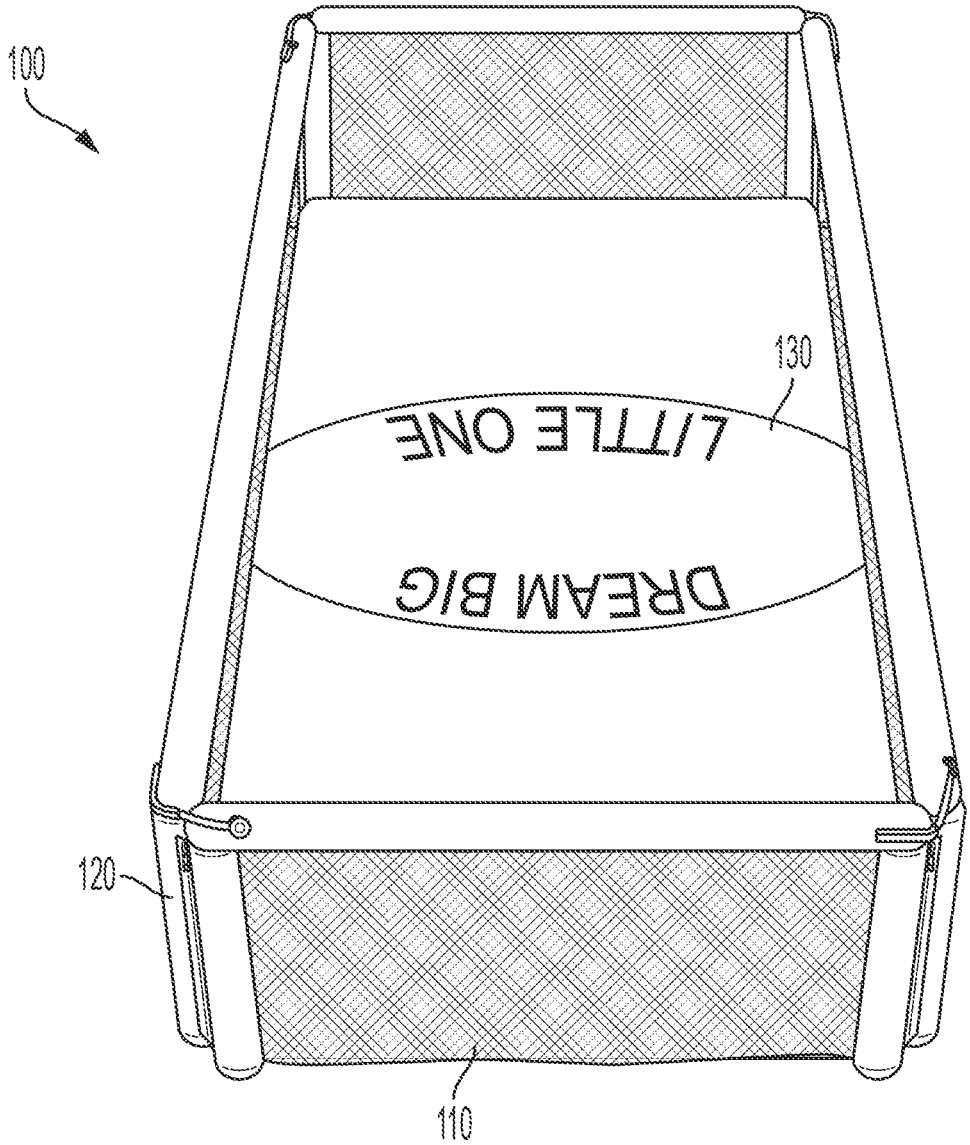
FIG. 1 is a perspective view of a co-sleeper apparatus with collapsible wall panels.

FIG. 1 is a perspective view illustrating a co-sleeper or bassinet 100 with collapsible wall panels 110. The bassinet is depicted in a "walled" or "closed" position, where the walls or wall panels 110 are upright, fixed, and/or secured together. In some embodiments, the wall panels are fixed, secured, or attached using zippers at attachment corners 120, but Velcro, hooks, or other securing mechanisms or devices can also operate to secure the wall panels 110 to one another in the walled or closed position, which is associated with a sleeping or secure mode of use for the bassinet 100.

In some cases, the walls or wall panels are made of a mesh material for breathability and visibility into the bassinet. Also, a wall or wall panel may be made using cloth or other lightweight material or fabric for portability, as well as to provide the parent in the bed to sleep near or on a wall or wall panel when the wall or wall panel is lying flat on the bed when open and unsecured, such as during a feeding or access mode of use of the bassinet 100. The material can be flame or fire proof or retardant, as is common with products for babies and small children.

The bassinet 100 also includes a base 130, which provides a sleeping surface for the baby. The base 130 can include one or more graphics ("Dream Big Little One"), as well as designs, images, and so on. The base 130 includes a rigid or solid surface to support the baby when the baby is placed in the bassinet 130 and may also include additional layers (optionally removable) of soft or comfortable material onto which the baby can play, sleep, move, and so on.

Figure 2:
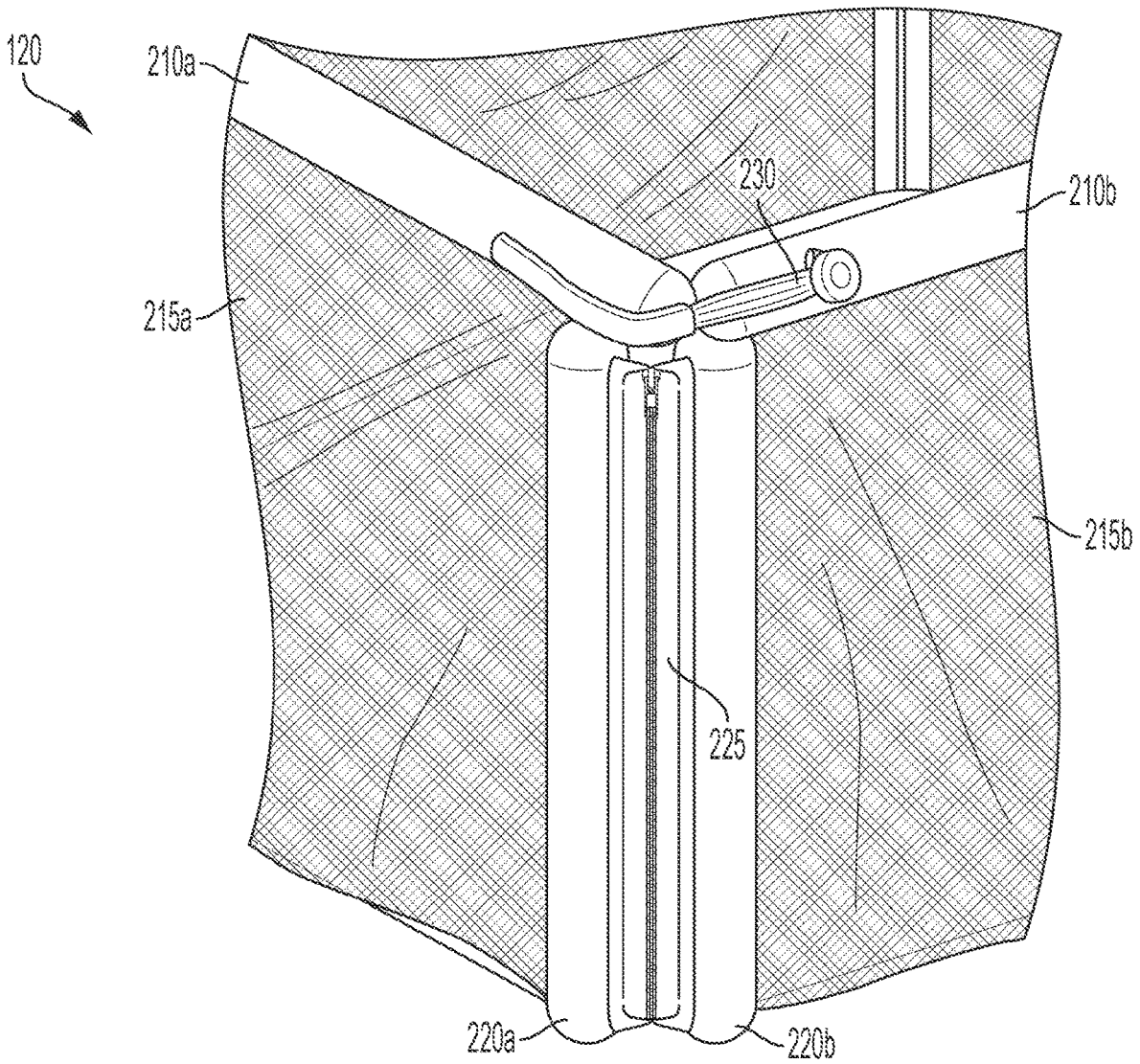
FIG. 2 is a diagram illustrating a corner of the co-sleeper apparatus in an attached position.

FIG. 2 provides additional details of the attachment corner 120 of the co-sleeper apparatus 100. The attachment corner 120, depicted in an attached or closed position in FIG. 2, includes a zipper 225 that moves vertically between two attachment members 220*a* and 220*b* of the wall panels 110. The attachment members 220*a*, 220*b* also form side members or side posts for the wall panels 110 of the bassinet 100. In addition to the zipper 225, other locking mechanisms can be utilized, including Velcro and other fasteners. Further, the zipper 225 may be a covered zipper, where cloth or material cover some or all of the teeth of the zipper when zipped up, preventing a baby from getting his/her fingers in the zipper 225. The zipper 225 can also lock in place when zipped.

For example, each wall panel includes a top member 210*a*, 210*b*, a mesh or center section 215*a*, 215*b*, and the attachment or side members 220*a*, 220*b*. The wall panels 110 also attach to the base 130 at a bottom portion of the wall panels 110, to allow the panels to rotate between the open position (where the wall panels 110 lie on the surface of the bed), a closed or upright position (forming the structure of the bassinet 100), and into other configurations (e.g., folded or carry-able) as described herein. In some cases, the wall panels 110 may attach to the base 130 via a bar or other attachment member that assists in securing the panel to the base 130.

In the closed position, a zipper 225 functions to bring together attachment member 220*a* to attachment member 220*b*. Further, a latch, or strap, 230 fixes the wall panels 110 together by attaching the top member 210*a* to top member 210*b*. The latch or strap 230 could also be a hook, a clasp, a snap-like mechanism, and so on. Thus, the zipper 225 functions as a bridge between the wall panels 210, and the latch mechanism 230 provides additional security and structural integrity to the co-sleeper structure, by bring the top members 210*a*, 210*b* of the adjoining and attached wall panels 110 together. In some cases, a single locking mechanism can include the zipper 225 and latch or strap 230.

Figure 3:
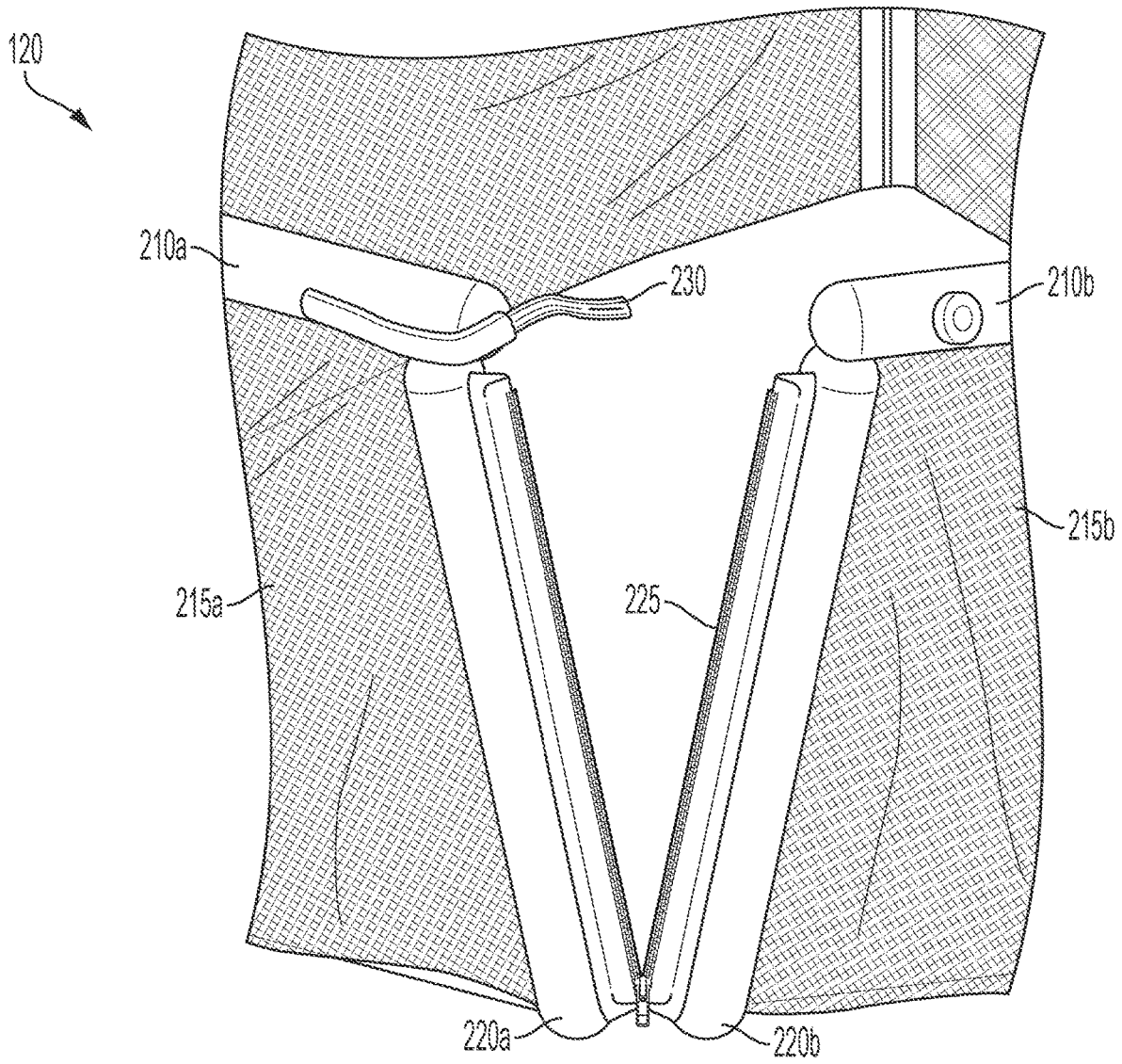
FIG. 3 is a diagram illustrating a corner of the co-sleeper apparatus in an unattached position.

FIG. 3 depicts the attachment corner 120 in an open or unattached state, where the zipper 225 is positioned in an unzipped configuration, and the latch or strap 230 is disengaged, allowing the wall panels to move away from each other and fold down into an open position (e.g., lying in parallel with the base 130 of the bassinet 100.

Figure 4:
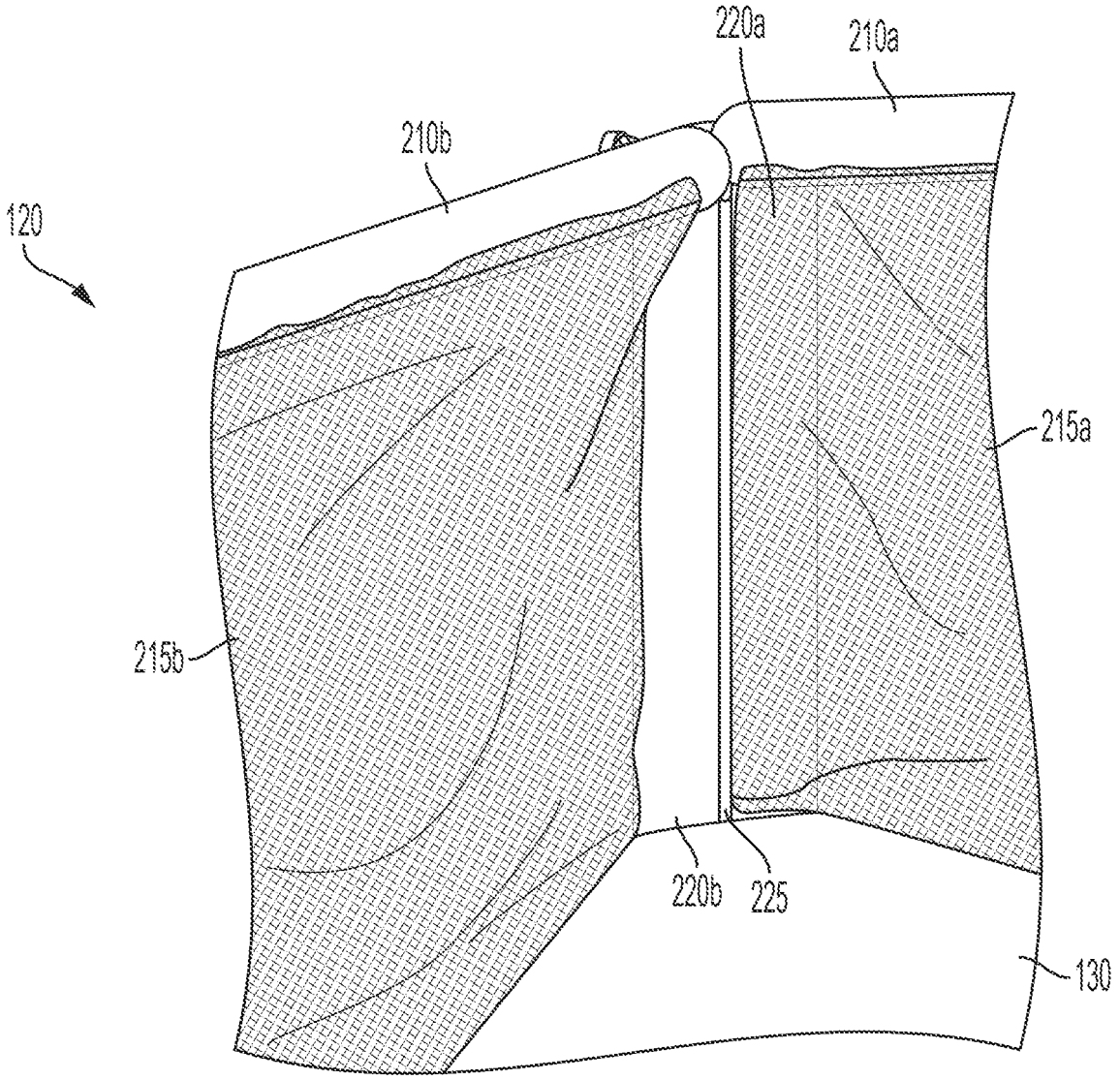
FIG. 4 is a diagram illustrating an internal view of the corner of the co-sleeper apparatus.

Further, FIG. 4 shows an inside or internal view of the attachment corner 120 of the co-sleeper or bassinet 100. As depicted, the zipper 225 is not accessible from an inside of the bassinet 100, and thus cannot be unzipped by a baby when inside the bassinet 100.

Figure 5:
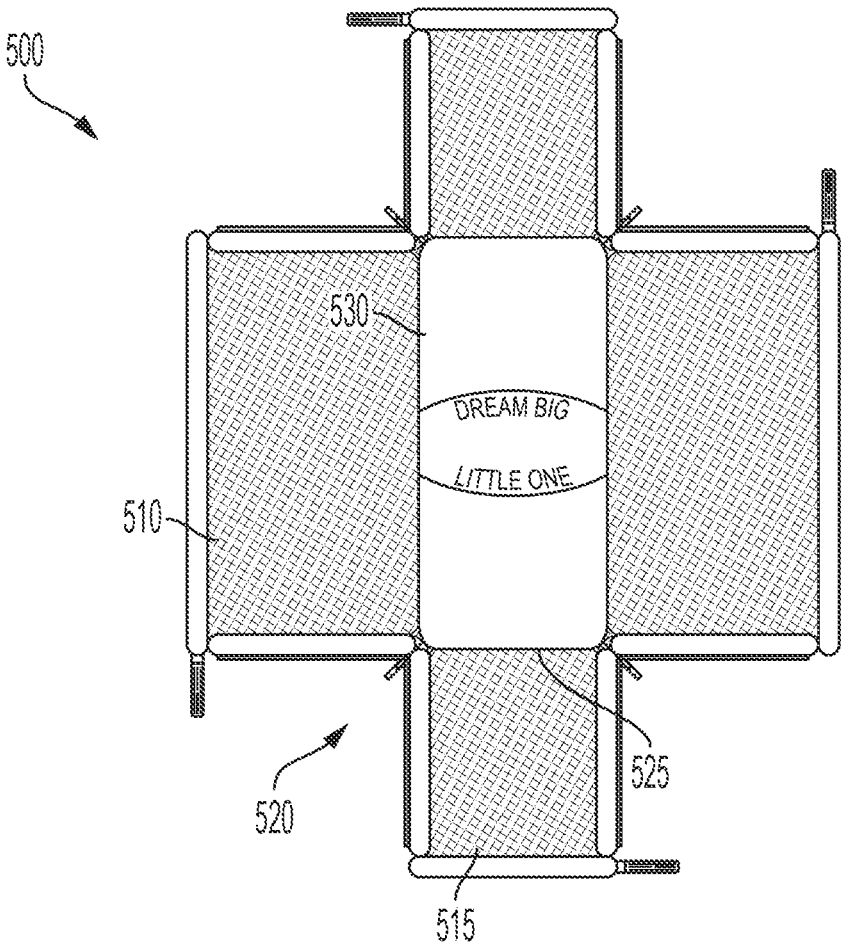
FIG. 5 is a diagram illustrating the co-sleeper apparatus in a collapsed or open position.

FIG. 5 depicts a top view of the co-sleeper bassinet 500 in an open, flat, or unattached position. The bassinet 500, similar to the bassinet 100, is depicted in a flat position, with four wall panels 510 and 515 lying flat on a surface (e.g., a bed). The bassinet 500 has attachment corners 520 in unattached state, with bottom sections of the wall panels 510, 515 attached to a base 530. For example, the wall panels 510, 515 can attach directly to the base 530, or can attach via a bar or other materials that secures the attachment, while allowing the wall panels 510, 515 to move into the positions described herein.

Figure 6:
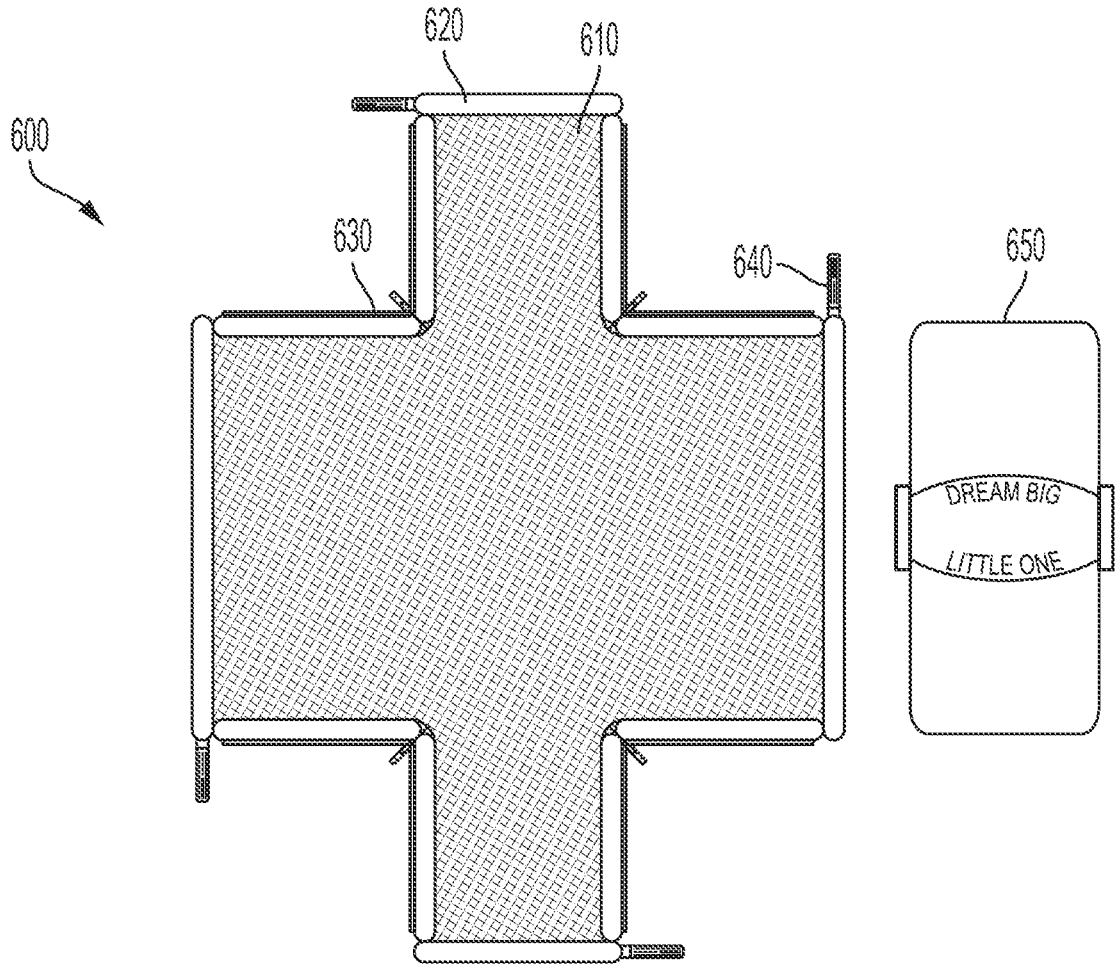
FIG. 6 is a diagram illustrating various components of the co-sleeper apparatus.

FIG. 6 depicts a co-sleeper or bassinet 600, in some embodiments, as a single piece structure. The bassinet 600 includes a body 610 made of lightweight material, such as cloth or mesh material or fabrics. The body 610 may be made of a unitary or single material, with a geometry that includes a base section 605 and four wall panels 615. A frame 620 is provide at a periphery or edge of the body 620 to provide the structure when the bassinet 600 is in a closed position.

In some cases, at least one side of the frame 620 (e.g., the side where the parent will be sleeping, in some cases the longer side) is made of a soft material, in order to enable the parent to sleep on top of the wall panel without much discomfort. Example materials include cloth, foam, cotton, and so on. Thus, one wall panel can include a frame portion (e.g., similar to top members 210*a*, 210*b*) having a soft or flexible material, and the other wall panels can have frame portions of a more rigid or strong material (e.g., wood, plastic, or metal), to ensure the bassinet 600 is sufficiently supported when in the closed or secure position. In some cases, the frame can be an inflatable component which, when inflated, provides structure to the co-sleeper.

As described herein, a locking or securing mechanism (e.g., zipper) 630 is disposed on the frame 620 to lock the wall panels together when placed upright in the secure or closed position. A latch 640 or strap disposed on the frame 620 provides additional structural integrity, as described herein. Further, a removable sleeping surface or pad 650 is configured to be placed on the base of the body 610 of the apparatus 600.

Figure 7:
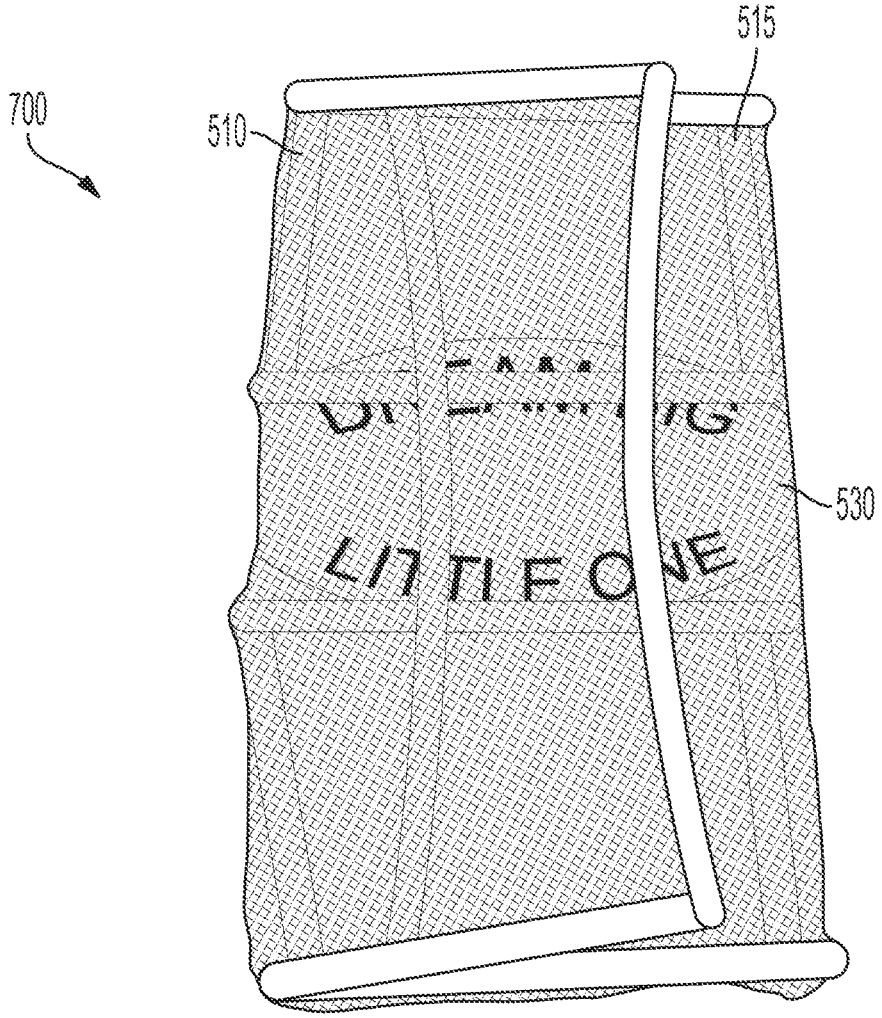
FIG. 7 is a diagram illustrating the co-sleeper apparatus in a folded or transportable position.

FIG. 7 depicts a top view of a co-sleeper or bassinet 700 in a folded position. The four wall panels 510, 515 are collapsed or folded inward to minimize the bassinet's size for portability. The folded co-sleeper 700 may then be carried in a bag or otherwise transported to different locations, such as a bed, floor, couch, and so on. In some cases, the bassinet 700 may be provided with Velcro (not shown) or other securing mechanisms to securely maintain the wall panels 510, 515 in the folded state when being carried around, as well as a handle or strap that facilitates carrying the bassinet in the configurations described herein.

While the bassinet or co-sleeper has been described herein as a generally rectangular structure, the bassinet can also be configured into other geometries, such as geometries having three wall panels, geometries having curved, oval, or circular shapes, and so on. Further, in some cases, the bassinet can include less than four corners configured to un-attach from one another, where, for example, only one or two wall panels are collapsible.

Thus, as described herein, a configurable bassinet or co-sleeper includes wall panels that have the sturdiness and safety of a traditional co-sleeping bassinet but can be collapsed or opened when placed in an open position. The bassinet, then, easily and quickly allows a parent to access a baby for feeding during the night without moving the baby out of the bassinet, while then securing the baby in the bassinet when the baby is sleeping, among other benefits.

Example Embodiments of the Bassinet

In some embodiments, the bassinet or co-sleeper includes a base configured to receive a sleeping pad, a first wall panel, a second wall panel, a third wall panel, and a fourth wall panel, where each wall panel is configured to be disposed in an upright position when the bassinet is in a secured configuration and to be disposed in a collapsed position when the bassinet is in an open position, multiple locking mechanisms that join a wall panel to another wall panel, where each of the locking mechanisms are partially disposed at corners of the bassinet and positioned to fix adjoining wall panels together when the bassinet is in the secured configuration to form the corners of the bassinet.

Further, the bassinet can include a frame disposed along an edge of the wall panels, where the frame is formed of a rigid material, and where the multiple locking mechanisms attach to the frame in order to fix the adjoining wall panels together. In some cases, as described herein, the frame can be partially formed of a flexible, or soft material, in order to provide comfort when lying down next to a parent. Further, the fame can be formed of an inflatable component, which, when inflated, provides a rigid structure around the bassinet.

Thus, the frame can include a first frame section disposed on an outer edge of the first wall panel, a second frame section disposed on an outer edge of the second wall panel, a third frame section disposed on an outer edge of the third wall panel, and a fourth frame section disposed on an outer edge of the fourth wall panel, where the first frame section, the second frame section, and the third frame section are formed of a rigid material, and where the fourth frame section is formed of a flexible or soft material.

In some cases, the frame is disposed along an outer edge of the wall panels, where the frame is formed of a rigid material, and where each of the wall panels is formed of a mesh material.

In some cases, the base, the first wall panel, the second wall panel, the third wall panel, and the fourth wall panel are a unitary structure. Thus, the bassinet can be a single structure configurable into different positions. For example, the first wall panel, the second wall panel, the third wall panel, and the fourth wall panel are configured to fold onto the base in a folded position of the bassinet.

In some embodiments, the bassinet, or sleeping apparatus, includes a sleeping pad and a configurable unitary structure. The unitary structure has a base and multiple wall panels attached to the base. Each wall panel is configured to lie flat in an open position of the sleeping apparatus and stand upright in a closed position of the sleeping apparatus.

In some cases, a zipper, Velcro, latch, or strap fixes a first wall panel to a second wall panel of the multiple wall panels to form a corner of the sleeping apparatus when the sleeping apparatus is in the closed position.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of implementations of the apparatus is not intended to be exhaustive or to limit the apparatus to the precise form disclosed above. While specific implementations of, and examples for, the apparatus are described above for illustrative purposes, various equivalent modifications are possible within the scope of the apparatus, as those skilled in the relevant art will recognize.

Any patents, applications and other references noted above, including any that may be listed in accompanying filing papers, are incorporated herein by reference. Aspects of the technology can be modified, if necessary, to employ the systems, functions, and concepts of the various references described above to provide yet further implementations of the technology.

These and other changes can be made to the invention in light of the above Detailed Description. While the above description describes certain implementations of the technology, and describes the best mode contemplated, no matter how detailed the above appears in text, the invention can be practiced in many ways. Details of the system may vary considerably in its implementation details, while still being encompassed by the technology disclosed herein. As noted above, particular terminology used when describing certain features or aspects of the technology should not be taken to imply that the terminology is being redefined herein to be restricted to any specific characteristics, features, or aspects of the technology with which that terminology is associated. In general, the terms used in the following claims should not be construed to limit the invention to the specific implementations disclosed in the specification, unless the above Detailed Description section explicitly defines such terms. Accordingly, the actual scope of the invention encompasses not only the disclosed implementations, but also all equivalent ways of practicing or implementing the invention under the claims.

What is claimed is:

1. A bassinet, comprising:

a base configured to receive a sleeping pad;

a first wall panel, a second wall panel, a third wall panel, and a fourth wall panel, each wall panel being configured to be disposed in an upright position when the bassinet is in a secured configuration and to be disposed in a collapsed position when the bassinet is in an open position;

multiple locking mechanisms that join a wall panel to another wall panel, each of the locking mechanisms being partially disposed at corners of the bassinet and positioned to fix adjoining wall panels together when the bassinet is in the secured configuration to form the corners of the bassinet; and a frame disposed along an outer edge of the wall panels, wherein the frame is distinct from the outer edge of the wall panels, the frame having:

a first frame section disposed on and extending along an outer edge of the first wall panel, a second frame section disposed on and extending along an outer edge of the second wall panel, a third frame section disposed on and extending along an outer edge of the third wall panel, and a fourth frame section disposed on and extending along an outer edge of the fourth wall panel;

wherein the first frame section, the second frame section, and the third frame section are formed of a rigid material, and wherein the fourth frame section is formed of a flexible or soft material, and the flexible or soft material is softer than the rigid material.

2. The bassinet of claim 1, wherein the fourth frame section is made of the soft material to enable the person to sleep on top of the fourth wall panel next to a baby in the bassinet.

3. The bassinet of claim 1, wherein each of the wall panels is formed of a mesh material.

4. The bassinet of claim 1, wherein the base, the first wall panel, the second wall panel, the third wall panel, and the fourth wall panel are a unitary structure.

5. The bassinet of claim 1, wherein each of the wall panels includes:

a center mesh section.

6. The bassinet of claim 1, wherein each of the wall panels includes:

a center mesh section, wherein the fourth frame section is formed of an inflatable component.

7. The bassinet of claim 1, wherein the multiple locking mechanisms include zippers configured to move in a vertical direction in order to form the corners of the bassinet.

8. The bassinet of claim 1, wherein the multiple locking mechanisms include latches configured to fix top sections of the walls panels to one another.

9. The bassinet of claim 1, wherein the base, the first wall panel, the second wall panel, the third wall panel, and the fourth wall panel are formed of a mesh fabric.

10. The bassinet of claim 1, wherein the first wall panel, the second wall panel, the third wall panel, and the fourth wall panel are configured to fold onto the base in a folded position of the bassinet.

11. A sleeping apparatus, comprising:

a sleeping pad; and a configurable unitary structure, wherein the unitary structure includes:

a base;

first, second, third, and fourth wall panels attached to the base, each of the wall panels being configured to lie flat in an open position of the sleeping apparatus and stand upright in a closed position of the sleeping apparatus; and a frame disposed along an outer edge of the wall panels, wherein the frame is distinct from the outer edge of the wall panels, the frame having:

a first frame section disposed on and extending along an outer edge of the first wall panel, a second frame section disposed on and extending along an outer edge of the second wall panel, a third frame section disposed on and extending along an outer edge of the third wall panel, and a fourth frame section disposed on and extending along an outer edge of the fourth wall panel;

wherein the first frame section, the second frame section, and the third frame section are formed of a rigid material, and wherein the fourth frame section is formed of a flexible or soft material, and the flexible or soft material is softer than the rigid material.

12. The sleeping apparatus of claim 11, wherein a zipper fixes the first wall panel to the second wall panel to form a corner of the sleeping apparatus when the sleeping apparatus is in the closed position.

13. The sleeping apparatus of claim 11, wherein a latch or snap fixes the first wall panel to the second wall panel of the multiple wall panels to form a corner of the sleeping apparatus when the sleeping apparatus is in the closed position.

14. The sleeping apparatus of claim 11, wherein the base and the first, second, third, and fourth wall panels are formed of a mesh cloth fabric.

15. The sleeping apparatus of claim 11, wherein the fourth frame section is made of the soft material to enable the person to sleep on top of the fourth wall panel next to a baby placed on the sleeping pad.

16. The sleeping apparatus of claim 11, wherein the first, second, third, and fourth wall panels are formed of a mesh cloth fabric, and the base is formed of a rigid material.

17. The sleeping apparatus of claim 11, wherein at least of one of the first, second, third, and fourth wall panels is a curved panel.

* * * * *